US006732407B2

(12) United States Patent
Weiss

(10) Patent No.: US 6,732,407 B2
(45) Date of Patent: May 11, 2004

(54) FORWARD-POSITIONABLE ERASER FOR A WRITING IMPLEMENT AND METHOD

(76) Inventor: Daniel Kamrath Weiss, 12016 Devilwood Dr., Potomac, MD (US) 20854

( * ) Notice: Subject to any disclaimer, the term of this patent is extended or adjusted under 35 U.S.C. 154(b) by 34 days.

(21) Appl. No.: 10/132,448

(22) Filed: Apr. 26, 2002

(65) Prior Publication Data

US 2003/0200990 A1 Oct. 30, 2003

(51) Int. Cl.[7] ..... B43K 29/02
(52) U.S. Cl. ..... 15/428; 15/424
(58) Field of Search ..... 15/424, 425, 426, 15/427, 428, 429, 430, 431, 432, 433, 434

(56) References Cited

U.S. PATENT DOCUMENTS

| | | | | |
|---|---|---|---|---|
| 35,467 | A | * | 6/1862 | Oliver |
| 384,563 | A | * | 6/1888 | Cross |
| 447,873 | A | * | 3/1891 | Hanimann |
| 1,395,793 | A | * | 11/1921 | Broschart |
| 1,473,090 | A | | 11/1923 | Ferry |
| 1,550,770 | A | * | 8/1925 | Akira |
| 1,598,873 | A | * | 9/1926 | Peterson |
| 2,496,086 | A | * | 1/1950 | Fitzgerald |
| 4,167,347 | A | * | 9/1979 | Hoyle |
| 4,899,419 | A | | 2/1990 | Saleen |
| 5,127,130 | A | | 7/1992 | Copito |
| 5,318,372 | A | * | 6/1994 | Besthorne |
| 5,555,602 | A | * | 9/1996 | Leamond |

FOREIGN PATENT DOCUMENTS

| | | |
|---|---|---|
| GB | 16751 | * of 1895 |
| GB | 530082 | * 12/1940 |

* cited by examiner

*Primary Examiner*—Randall Chin
(74) *Attorney, Agent, or Firm*—Jeffrey Weiss; Harry M. Weiss; Weiss, Moy & Harris, P.C.

(57) ABSTRACT

A writing implement having a forward-positioned eraser, and method. The eraser circumscribes the shaft of the writing implement, and may have an annular or doughnut shape. The eraser may be affixed to the shaft portion, for example where used with a fixed-length writing implement such as a mechanical pencil or erasable pen. The eraser may, alternatively, be slidable along the shaft portion, which would make the eraser useable with a sharpenable pencil, the length of which will be changed as a result of sharpening.

5 Claims, 1 Drawing Sheet

FIG. 1
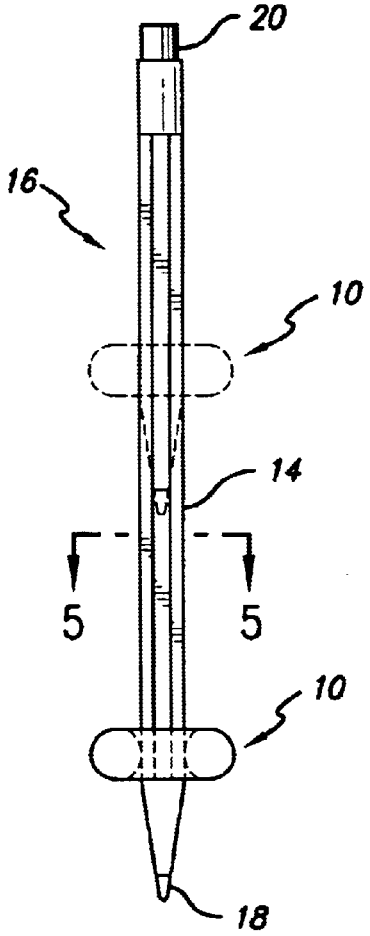
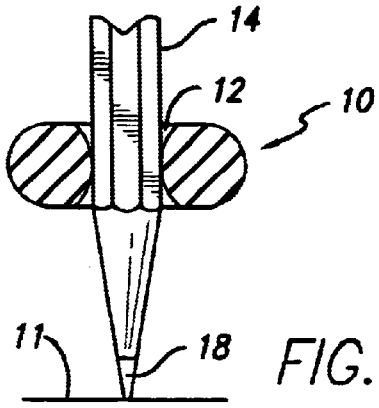
FIG. 2
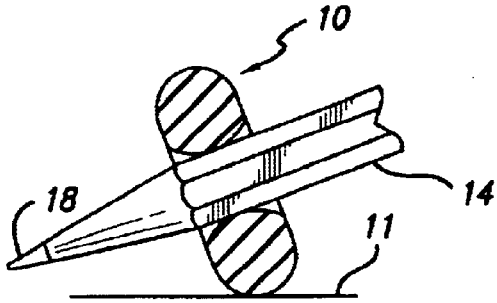
FIG. 3
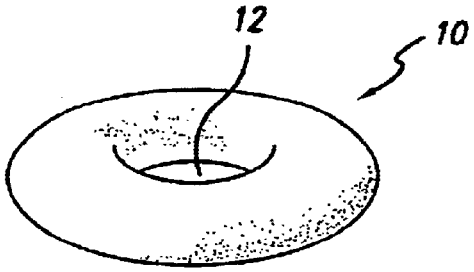
FIG. 4
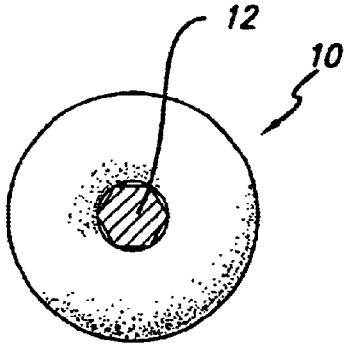
FIG. 5

FORWARD-POSITIONABLE ERASER FOR A WRITING IMPLEMENT AND METHOD

FIELD OF THE INVENTION

This invention relates generally to erasing devices and methods for writing implements, and, more particularly, to an eraser positionable proximate a writing end of a writing implement.

BACKGROUND OF THE INVENTION

Writing implements such as pencils and certain pens that produce an erasable writing material provide the need for a suitable eraser. Typical prior art erasers include erasers permanently affixed to the end of the writing implement opposite the writing end. Erasers are also provided that are separate from the writing implement.

With the typical, permanently affixed prior art eraser, it is necessary to invert the writing implement in order to utilize the eraser. This maneuver interrupts the flow of the user's writing, is relatively time-consuming, and requires some amount of manual dexterity. (The expenditure of time can be particularly costly when the writer is engaged in the performance of a time-sensitive task, such as participation in a "Mad Minute" test.) With erasers that are separate from the writing implement, it is necessary to first release the writing implement, and only then to grasp and utilize the eraser in an erasing action. Of course, separate erasers suffer from the further deficiency that they are prone to being lost.

A need exists for an eraser that is positioned proximate the writing end of the writing implement, so that a user can utilize the eraser while still grasping the writing implement in substantially the same manner and without having to invert or release the writing implement. It would be preferred, in one embodiment, to allow the position of the eraser to be adjustable, to take into account a shortening of the length of the writing implement as a result of the sharpening thereof. The present invention satisfies these needs and provides other, related, advantages.

SUMMARY OF THE INVENTION

It is an object of the present invention to provide an eraser for a writing implement wherein the eraser is positioned proximate the writing end of the writing implement.

It is a further object of the present invention to provide an erasing method that permits a user to perform an erasing task without the need for inverting or releasing the writing implement.

It is yet a further object of the present invention to provide an eraser positionable proximate a writing end of a writing implement, and capable of having its positioned adjusted along a length of the writing implement to take into account a shortening of the length of the writing implement as a result of the sharpening thereof.

BRIEF DESCRIPTION OF THE PREFERRED EMBODIMENTS

In accordance with one embodiment of the present invention, a writing implement having a forward-positioned eraser is disclosed. The writing implement comprises, in combination: a writing implement having a shaft portion and a writing point and being dimensioned to be grasped by a user hand along said shaft portion during use of said writing implement for a writing task; and an eraser positioned along said shaft portion between said writing point and a position of said user hand during said writing task; wherein said eraser circumscribes said shaft portion.

In accordance with another embodiment of the present invention, a method for erasing is disclosed. The method comprises the steps of: providing a writing implement having a shaft portion and a writing point and being dimensioned to be grasped by a user hand along said shaft portion during use of said writing implement for a writing task; providing an eraser positioned along said shaft portion between said writing point and a position of said user hand during said writing task; wherein said eraser circumscribes said shaft portion; said user hand grasping said writing implement along said shaft portion; angling said writing implement so that said writing point is not in contact with a writing surface and so that an outer surface of said eraser is in contact with said writing surface; performing an erasing movement on said writing surface by repetitively rubbing said outer surface of said eraser across said writing surface.

The foregoing and other objects, features, and advantages of the invention will be apparent from the following, more particular, description of the preferred embodiments of the invention, as illustrated in the accompanying drawings.

BRIEF DESCRIPTION OF THE DRAWINGS

FIG. 1 is a front view of a writing implement having an eraser positioned proximate a writing point thereof, and illustrating slidability of the eraser as the writing implement is shortened.

FIG. 2 is a front of a writing implement having an eraser positioned proximate a writing point thereof, with the eraser shown in cross section.

FIG. 3 is a side view of a writing implement having an eraser positioned proximate a writing point thereof, illustrating placement of the eraser in a position for an erasing action on a writing surface.

FIG. 4 is a perspective view of an embodiment of an eraser positionable proximate a writing point of a writing implement, having a round internal opening.

FIG. 5 is a top view of an embodiment of an eraser positionable proximate a writing point of a writing implement, having a hexagonal internal opening.

DETAILED DESCRIPTION OF THE PREFERRED EMBODIMENTS

Referring first to FIGS. 1–4, an embodiment of an eraser 10 is shown. The eraser 10 is preferably annular in shape, and defines therethrough an opening 12 dimensioned to be fitted over the shaft portion 14 of a writing implement 16. The writing implement 16 further includes a writing point 18.

The term "writing implement" as used herein is intended to include any device capable of being used for the act of writing and producing an erasable product on a writing surface 11. The term writing implement is intended to include, but is not limited to, wooden pencils, mechanical pencils, pens having an erasable ink, markers having an erasable ink, and the like.

It should be noted further that writing implements 16 exhibit different shaft configurations. Standard wood pencils, for example, often have a hexagonal shaft, though cylindrical shafts are also known. Pens, as well, are known to have hexagonal shafts, cylindrical shafts, and shafts of other shapes. The term "shaft" as used herein, therefore, is intended to refer to the portion of a writing implement 16 that is between the writing point 18 and the position of a hand of a user utilizing the writing implement 16 for writing purposes, regardless of its external shape. It should be understood therefore that it will be desired to configure the opening 12 so as to conform to the shape of the shaft portion 14 of the particular writing implement 16 with which the eraser 10 is to be utilized. (However, it should be further recognized that it may be acceptable to position an eraser 10 having, for example, a round opening 12 over a writing implement having, for example, a hexagonal shape while still providing a sufficiently strong fit for use of the eraser 10.) It is expected, therefore, that eraser 10 will be produced having openings 12 in a variety of configurations. By way of example, FIG. 4 provides an illustration of an eraser 10 having a round opening 12, FIG. 5 provides an illustration of an eraser 10 having a hexagonal opening. Other configurations of the opening 12 are also possible.

It should be noted further, with respect to the opening 12, that it will be desired to size the opening 12 so that it engages in a relatively tight manner with the shaft portion 14. In this regard, it is preferred that the fit be sufficiently tight so that, during the performance of an erasing action, the eraser 10 will not move either along or around the shaft portion 12.

In one embodiment, the eraser 10 is intended to be positioned onto the shaft portion 12 by inserting the writing implement 16 therethrough—preferably by inserting the writing point 18 therethrough. In this embodiment, the opening 12 of the eraser 10 should be dimensioned so that a snug fit is achieved as the eraser 10 contacts the unsharpened region of the shaft portion 12. (For some uses, it may be preferred to dimension the opening 12 so that a snug fit is achieved as the eraser 10 contacts the upper sharpened region.) In this embodiment, which would typically be used with a sharpenable wooden pencil type of writing implement 16, the eraser 10 should be moveable upward along the shaft portion 12 as it becomes necessary to sharpen the writing point 18 and thereby diminish the length of the shaft portion 12. Such movement in response to shortening of the length of the shaft portion 12 is illustrated in FIG. 1.

In another embodiment, which could be suitable, for example, for use with erasable pen and mechanical pencil types of writing implements, it may be desired to permanently affix the eraser 10 to the shaft portion 12. In this embodiment, because the length of the shaft portion 12 will not be changed as a result of sharpening, it will not be necessary to make the eraser 10 moveable. On the other hand, it may be desirable to provide a moveable eraser 10 even with writing implements 16 having fixed-length shafts, since such moveability makes the eraser 10 separately purchasable and addable later, and further because such moveability allows an individual user to custom position the eraser 10 to suit his or her preferences.

Attention is now directed to the outer surface of the eraser 10. It may be desired to provide a rounded, doughnut-shaped outer and inner convex surface as shown by way of example in FIGS. 2–5. On the other band, a flatter surface may also be desirable. Other variables are also possible, including the provision of raised or bumped regions (not shown) along the outer surface of the eraser 10. The thickness and width of the eraser 10 may also be varied, as desired. Provision of a thicker eraser 10 (i.e., one projecting farther outward from the writing implement 16) will permit a user to perform an erasing operation with minimal tilt of the writing implement 16 but, on the other hand, an unduly thick eraser 10 could interfere with the writing action. A preferred thickness is one in which the dual functions of writing and erasing are optimally served.

STATEMENT OF OPERATION

To utilize the eraser 10, the first step is to position the eraser 10 proximate the writing point 18 and between the writing point 18 and the hand of the user when the writing implement 16 is held in a writing position. As noted, this positioning can be permanent, for use with writing implements 16 of fixed length, or could be alterable at the discretion of the user by moving the eraser 10 along the shaft portion 12 until the desired position is located. The optimal position will be one that is between the writing point 18 and the hand of the user, that will not interfere with the user's writing activity, and that will permit the user to angle the writing implement 16 to perform an erasing action without simultaneously having the writing point 18 contact the writing surface 11 upon which the user is working. It is generally considered that placement of the eraser 10 in the unsharpened region, proximate the end of that region and the beginning of the sharpened region, will be preferred.

The user may now use the writing implement 16 to write on the writing surface 11. As illustrated in FIG. 3, when it becomes necessary to erase, the user may continue to grasp the writing implement 16 in the same manner as during the writing function, tilt the writing implement 16 so as to bring the outer surface of the eraser 10 into contact with the writing surface 11 and so as to break contact between the writing point 18 and the writing surface 11. A back and forth erasing motion may then be performed in the desired area.

It may be preferred to provide the eraser 10 in combination with a fixed, end eraser 20 on the end of the writing implement 16, as shown in FIG. 1. Such a configuration can give the user the option of erasing with the eraser 10 or with the fixed eraser 20, with the fixed eraser 20 perhaps being preferred for large erasing tasks requiring relatively significant downward force and the eraser 10 being preferred for more discrete erasing tasks.

While the invention has been particularly shown and described with reference to preferred embodiments thereof, it will be understood by those skilled in the art that the foregoing and other changes in form and details may be made therein without departing from the spirit and scope of the invention.

I claim:

1. A writing implement having a forward-positioned eraser comprising, in combination:

a writing implement having a shaft portion comprising an unsharpened region and a sharpened region therebelow terminating in a writing point and being dimensioned to be grasped by a user's hand along said unsharpened region of said shaft portion during use of said writing implement for a writing task; and an eraser positioned along said unsharpened region of said shaft portion above said sharpened region and below an area on said unsharpened region wherein said user's hand is positioned during said writing task so as not to contact said user's hand during said writing task; wherein said eraser is substantially doughnut shape and has a convex inner surface and a convex outer surface; and sz wherein said eraser circumscribes said shaft portion.

2. The writing implement of claim 1 wherein said writing implement is a sharpenable pencil.

3. The writing implement of claim 1 further comprising a fixed eraser located at an end of said shaft portion of said writing implement, opposite said writing point.

4. The writing implement of claim 1 wherein said eraser is slidable along said shaft portion.

5. The writing implement off claim 1 wherein said eraser is affixed to said shaft portion.

* * * * *